US006276628B1

(12) United States Patent
Focke et al.

(10) Patent No.: US 6,276,628 B1
(45) Date of Patent: Aug. 21, 2001

(54) APPARATUS FOR HANDLING REELS

(75) Inventors: Heinz Focke, Verden; Jens Renken, Dohren, both of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/245,623

(22) Filed: Feb. 5, 1999

(30) Foreign Application Priority Data

Feb. 17, 1998 (DE) ..... 198 06 432

(51) Int. Cl.[7] ..... B65H 19/00

(52) U.S. Cl. ..... 242/559.1; 242/559.4; 414/427; 414/648; 414/911

(58) Field of Search ..... 242/559.1, 559.4, 242/533.2; 414/427, 428, 648, 911

(56) References Cited

U.S. PATENT DOCUMENTS 5,487,638 1/1996 Salsburg et al. ..... 414/796.9

FOREIGN PATENT DOCUMENTS

2613237A1 10/1977 (DE) .
3812514C2 10/1989 (DE) .
4116535A1 12/1991 (DE) .
4041865C2 7/1992 (DE) .
4341925A1 6/1995 (DE) .
4436716A1 4/1996 (DE) .
0033689A1 8/1981 (EP) .
0188787B1 7/1986 (EP) .
0311869A 4/1989 (EP) .
0649806A 4/1995 (EP) .
0664268A 7/1995 (EP) .
2548948A 1/1985 (FR) .
2145046 * 3/1985 (GB) .

* cited by examiner

*Primary Examiner*—John Q. Nguyen

(57) ABSTRACT

Apparatus for handling reels (10) by means of a vertical reel conveyor (15). The latter is provided with a lifting head (18) which can be moved up and down on a vertical bearing column (17) and has a projecting conveyor journal (19) for moving into a centre opening (11) in a reel (10) which is to be picked up. The reels (10) are arranged one above the other in the region of a stock of reels (13), with their centre openings (11) running vertically. The lifting head (18) or part of this head can be rotated in order to transfer the reel (10) to the working journal (16).

3 Claims, 6 Drawing Sheets

29
22
42
18
26
16
30
15
43
24
20
17
21
19
15
41
44
11
12
10
27
13
14

10
11
12
18
19
20
21
41
42
43

APPARATUS FOR HANDLING REELS

BACKGROUND OF THE INVENTION

Field of the Invention

The invention relates to an apparatus for handling reels, i.e. wound material webs, in particular of packaging material, such as paper, cardboard, tin foil or film, a reel conveyor feeding the reels individually from a stock of reels to a working journal which moves into a centre opening formed by the reel, preferably in conjunction with a packaging machine.

Thin packaging material, such as paper, tin foil or film, is provided for a packaging machine in the form of large, heavy reels. Reels are to be fed to a working journal arranged on the packaging machine, i.e. rotatable bearing journals on which the reel is mounted with its centre opening so that the material web can be drawn off as the reel revolves.

BRIEF SUMMARY OF THE INVENTION

The invention is based on the object of simplifying the automatic mechanical transfer of reels from a stock of reels to a working journal, on the one hand with regard to the arrangement of the reels in the stock of reels and on the other hand with regard to the handling and transfer of the reels to the working journal.

In order to achieve this object, the apparatus according to the invention is characterised by the following features:

a) the reels are positioned above one another in the region of the stock of reels, with their centre openings running vertically, b) the reel conveyor has a lifting head which can be moved up and down in order to take hold of in each case one reel, c) a reel bearing member for taking hold of a reel in a positively-locking and/or non-positively-locking manner is arranged on the lifting head, d) after it has picked up a reel from the stock of reels, the lifting head or the reel bearing member can be rotated in such a manner that the reel can be fed to the working journal in the vertical position with the centre opening oriented horizontally.

The way in which the reels are delivered means that it is better to position them with their centre openings centred in the vertical direction. The reels are handled using a reel conveyor which is designed according to the invention and has a reel bearing member, in particular a conveyor journal, which can be moved up and down on a vertical bearing device and moves in a positively-locking and/or non-positively-locking manner into the centre opening in the top reel, then lifts this reel off the stack by moving upwards and by rotating it by 90° moves it into the transfer position in front of the working journal of the packaging machine.

One special feature of the invention lies in the handling of the lifting head with the reel bearing member for the reel. The lifting head can be moved up and down by means of a single vertical conveyor, preferably by means of an endless toothed belt. The lifting head is rotated automatically at the top end region of its upward movement by having the vertical movement translated into a rotational movement of the lifting heads by means of the corresponding actuating members.

The transfer of the reel from the conveyor journal to the working journal is also carried out mechanically, specifically by means of a slide which is arranged on the conveyor journal, can be moved in the axial direction and pushes the reel off the conveyor journal and onto the working journal.

Further features of the invention relate to the configuration and operating method of the lifting head and of the reel conveyor as well.

BRIEF DESCRIPTION OF THE SEVERAL VIEWS OF THE DRAWINGS

An exemplary embodiment of the apparatus according to the invention is explained in more detail below with reference to the drawings, in which.

DETAILED DESCRIPTION OF THE INVENTION

Figure 1:
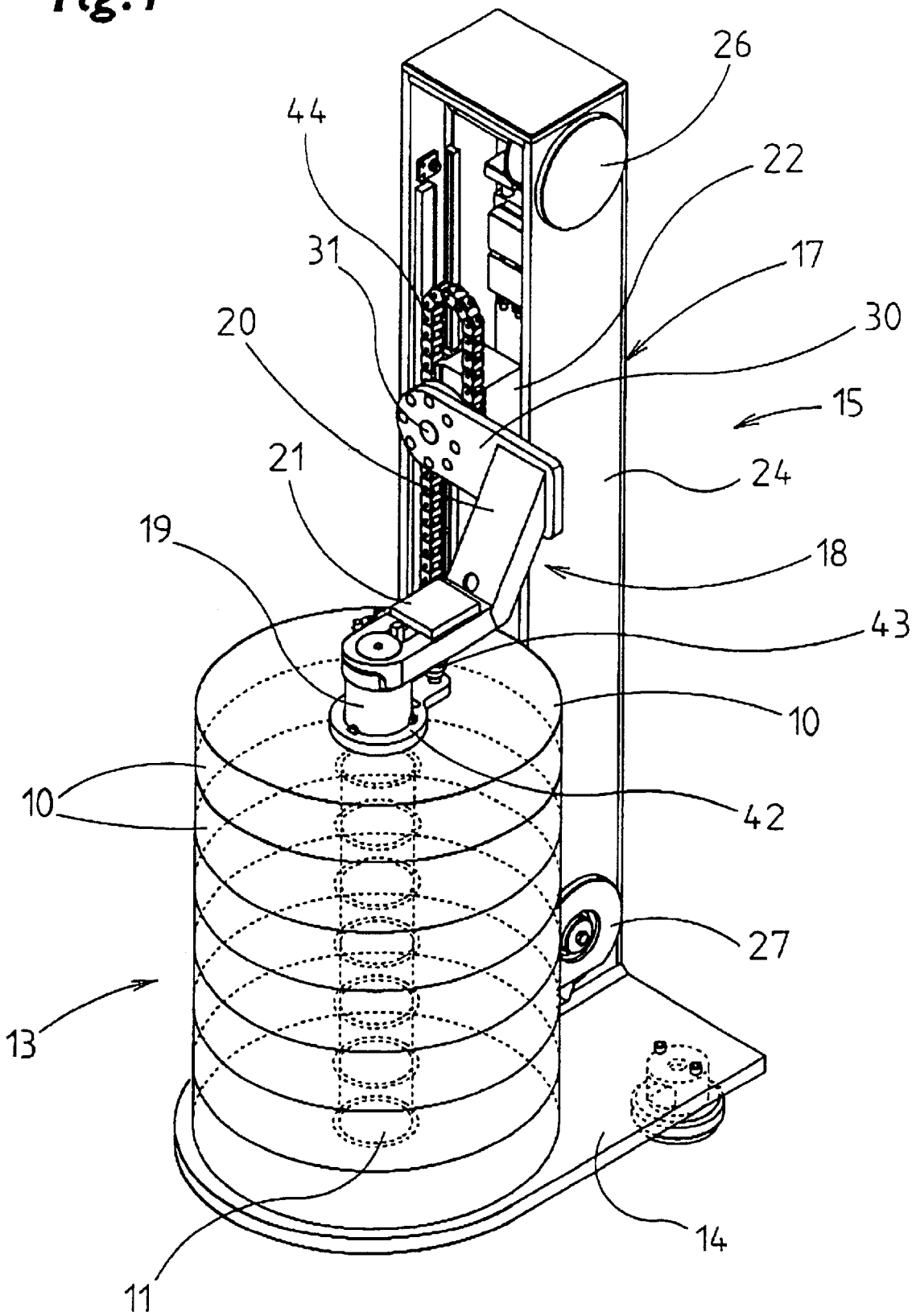
FIG. 1 shows a perspective view of a reel conveyor with a stock of reels.

The details illustrated in the drawings relate to the handling of reels 10, i.e. wound webs of packaging material, such as paper, tin foil, film, etc. The reel 10 is provided with a centre opening 11 which is formed by a cylindrical reel core 12. The latter is made from cardboard, plastic or possibly metal.

The reels 10 are transported, namely moved essentially upwards and, in the process, turned. In the starting position, the reels are positioned in such a way that the reel core 12 and hence the centre opening 11 are arranged vertically. A stock of reels 13 is formed by a plurality of reels 10 positioned above one another. The centre openings 11 and the reel cores 12 are arranged coaxially. The stock of reels rests on a baseplate 14.

A reel conveyor 15 picks up in each case one reel 10, specifically the top reel from the stacked stock of reels 13, conveys the reel 10 in question upwards while rotating it into a vertical plane—in which the centre opening 11 is oriented precisely or approximately horizontally—and transfers the reels 10 to a receiving member, in this case to a working journal 16 of a packaging machine.

In order for the material of the reel 10 to be processed, this reel is arranged rotatably on the working journal 16 or can be rotated by this journal. In the process, the web of material is pulled off the reel and fed to processing units of a packaging machine or of some other machine, in particular for the production of blanks.

Figure 2:
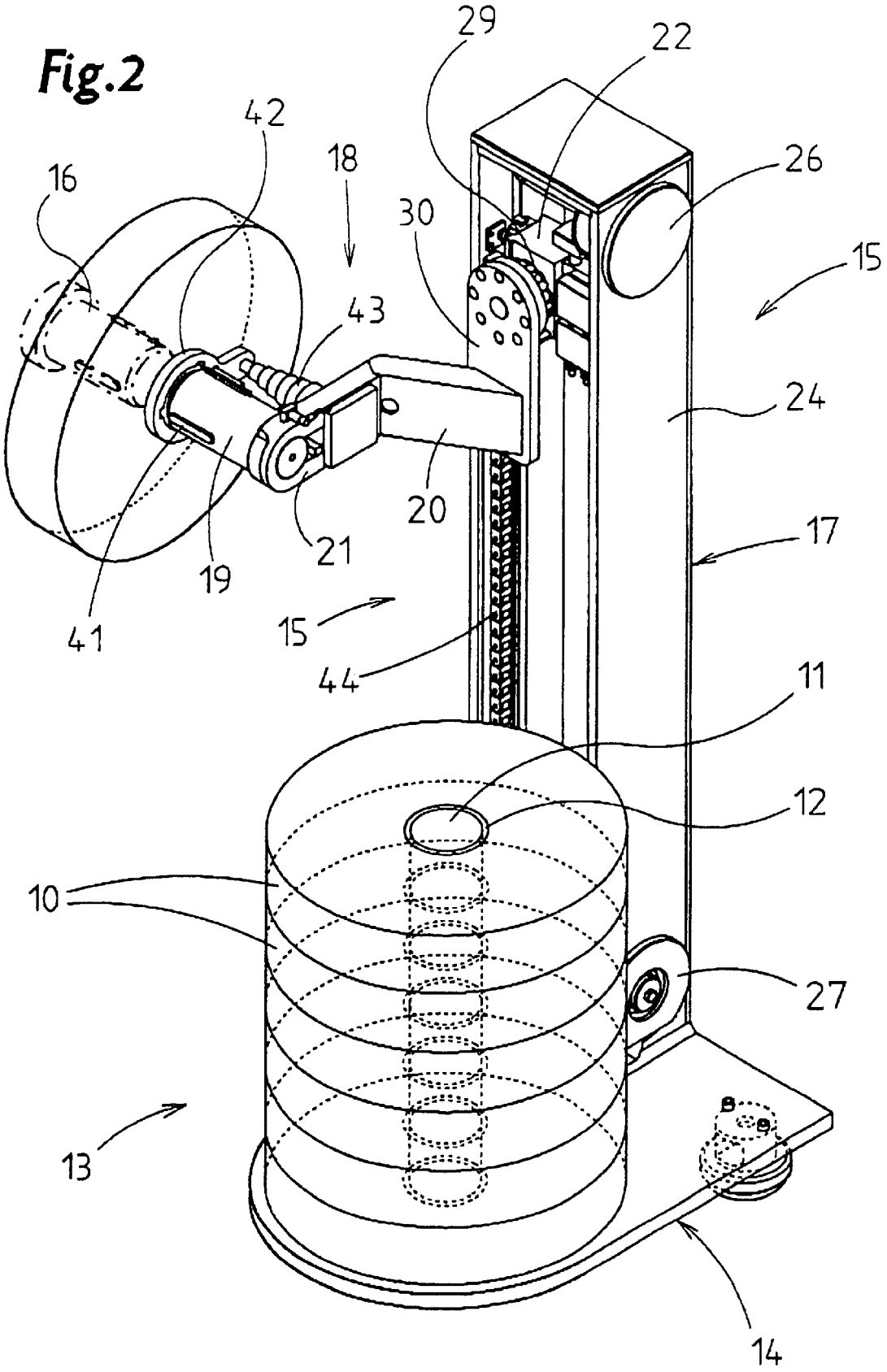
FIG. 2 shows the reel conveyor in accordance with FIG. 1 when transferring a reel onto a working journal.

The reel conveyor 15 comprises a vertical bearing column 17. In the present example, this column is positioned on the common baseplate 14, specifically at the edge of the latter. A conveyor member for the reels 10, namely a lifting head 18, is arranged movably on the bearing column 17. This bearing head can move up and down along the bearing column 17. A reel bearing member, which in the present exemplary embodiment is a conveyor journal 19, is arranged on the lifting head in order to take hold of a reel 10. This conveyor journal moves into the centre opening 11 in the top reel 10 of the stock of reels 13 from above and is anchored in the centre opening 11 or on the reel 10. The lifting head 18 is then moved upwards together with the reel 10. During the upwards movement or at the end of this movement, the lifting head 18 or part of the latter is pivoted through 90°. During this movement, the reel 10 is moved into the vertical position and, at the same time, advanced towards the working journal 16 of the packaging machine. In the process, the conveyor journal 19 is positioned so that it is aligned axially in front of the working journal 16 (FIG. 2). The reel 10 can then be pushed in the axial direction off the conveyor journal 19 and onto the working journal 16.

The design of the lifting head 18 and the arrangement of the conveyor journal 19 on the latter are such that the conveying movement, namely the upwards movement of the lifting head 18 and the rotation, causes the reels 10 to carry out an upwards movement, a rotational or tilting movement and a sideways movement until they are in the transfer position in front of the working journal 16.

The lifting head 18 is designed as a bearing arm which is angled off and projects from the bearing column 17, with a limb 20 which in the bottom position is oriented obliquely downwards and a bearing limb 21 which adjoins the former limb and is oriented horizontally. The reel bearing member, namely the conveyor journal 19, is arranged on this bearing limb 21. The said conveyor journal is arranged at the free end of the bearing limb 21, projecting freely in the transverse direction with respect to the latter.

Figure 6:
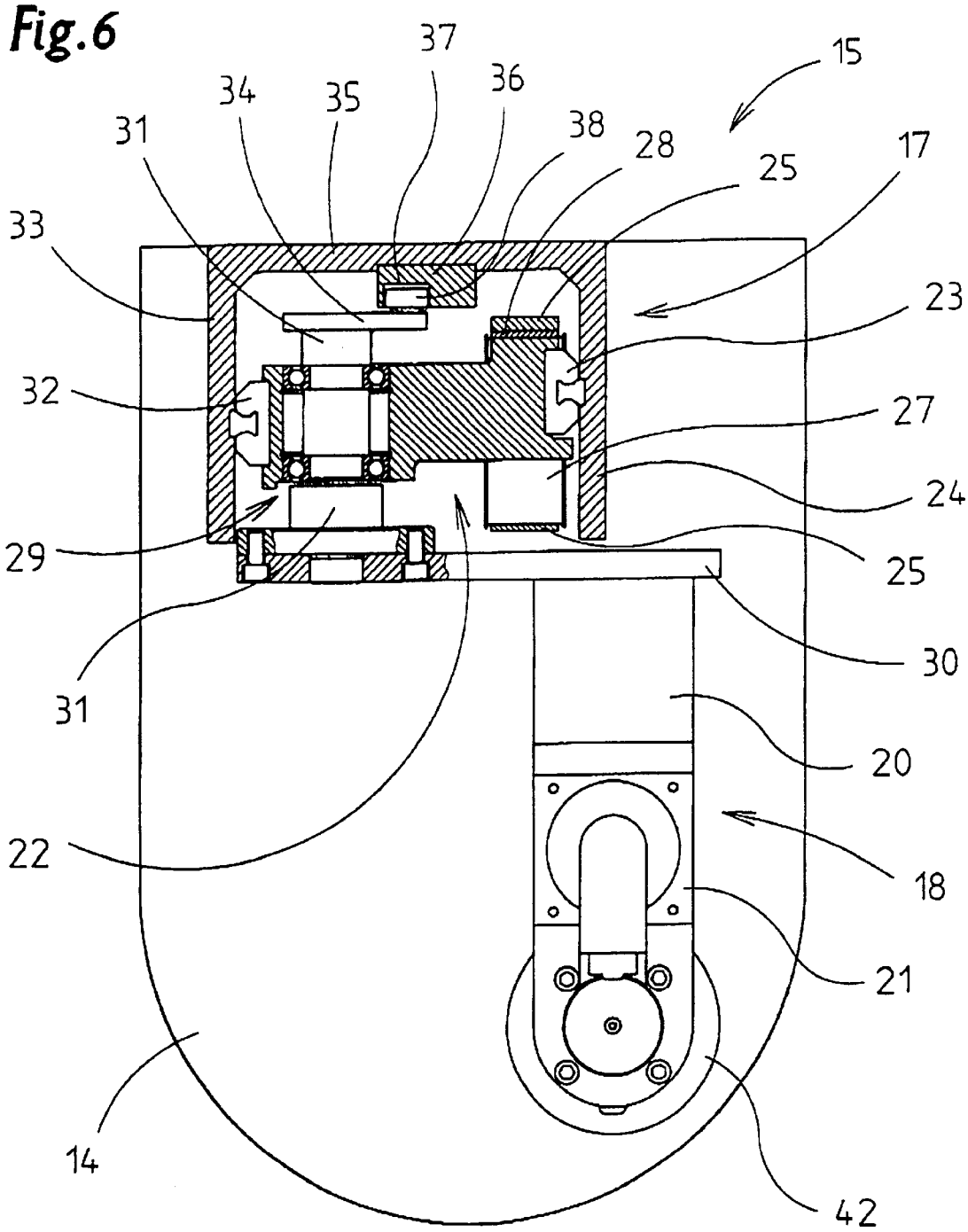
FIG. 6 shows a horizontal section through the reel conveyor, in the sectional plane VI—VI from FIG. 5, on an enlarged scale.

The lifting head 18 is connected to a guide member on or in the bearing column 17, specifically to a carriage 22 which can move up and down. This carriage runs on a vertical guide 23 in the bearing column 17, which is U-shaped in cross section (FIG. 6). The guide, which is designed as a rail, is arranged on a side wall 24 of the bearing column 17.

The carriage 22 and hence the lifting head 18 can be moved up and down by an endless conveyor, specifically by a toothed belt 25. The latter also runs inside the bearing column 17, via a top deflection roller 26 and a bottom drive roller 27. The carriage 22 is attached to a vertical strand 28 of the toothed belt 25.

Figure 5:
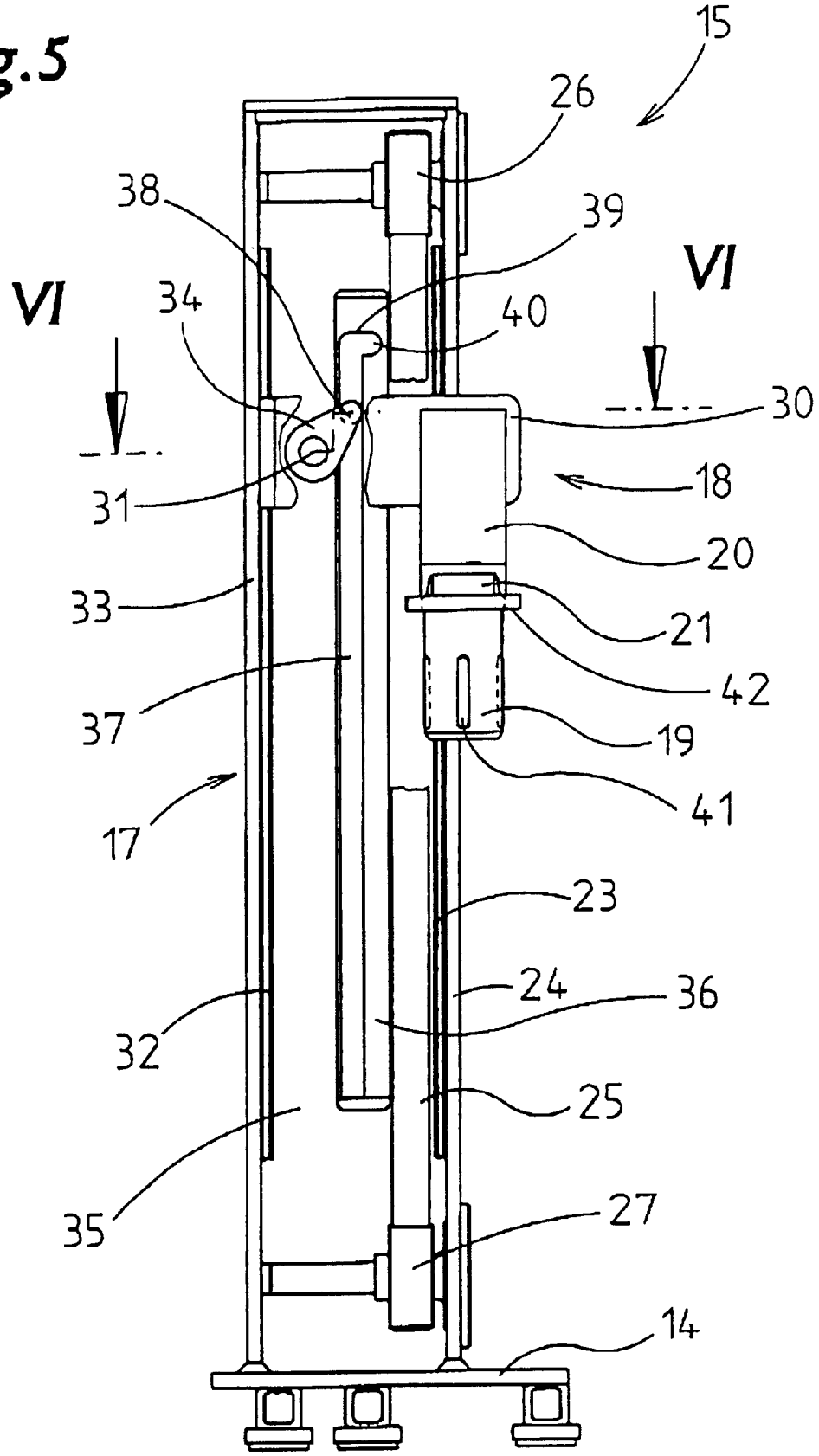
FIG. 5 shows a vertical section through the reel conveyor.

In order for the lifting head 18 to carry out the rotational or pivoting movement, it is connected to a pivot bearing 29 arranged on the carriage 22. The lifting head 18 is arranged offset with respect to the pivot bearing 29 and is connected to the pivot bearing 29 via an intermediate carrier, namely via a bearing bracket 30. The bearing bracket 30 acts in the manner of a single-armed lever which can be pivoted through in each case 90° about the pivot bearing 29. The bearing bracket 30 is arranged outside the bearing column 17, specifically in front of the latter, and is connected to a pivot pin 31 which is mounted in the pivot bearing 29. The carriage 22 is guided, on the side of the pivot bearing 29, in a further guide 32 which is arranged on a side wall 33 of the bearing column 17 which lies opposite the side wall 24. In the present reel conveyor 15, the rotational movement of the lifting head 18 takes place at the upper end of the lifting movement. This is arranged in such a way that the pivoting movement positions the reel 10 in question immediately in front of the working journal 16 in order for the reel to be transferred to the latter. The pivoting movement is carried out mechanically, namely by an actuating lever 34 which is arranged on the pivot pin 31, specifically at an end, inside the bearing column 17, which is opposite to the bearing bracket 30. The actuating lever 34 is controlled by means of a connecting link guide. A cam rail 36 is arranged on a rear wall 35 of the bearing column 17. This rail has a guide groove 37 in which there runs a contact roller 38 which is connected eccentrically to the actuating lever 34. The guide groove 37 runs predominantly vertically (FIG. 5). A top end of the guide groove 37 forms a stop 39 for the contact roller 38. The latter runs up against the stop 39, with the result that continued upwards movement of the lifting head 18 or of the carriage 22 pivots the actuating lever 34 in the clockwise direction (FIG. 5). This pivoting movement of the actuating lever 34 brings about a corresponding rotational or pivoting movement of the lifting head 18 together with the reel 10. In the process, the contact roller 38 is diverted into a lateral groove 40 of the guide groove 37.

The conveyor journal 19 is anchored in the centre opening 11 in order to pick up a reel 10. In the present exemplary embodiment, holding members, specifically clamping jaws 41, which can be extended laterally or in the radial direction, are provided on the conveyor journal 19. These jaws are pressed against the inside of the reel core 12 so that the reel 10 is held on the conveyor journal 19 by clamping action or by the frictional force applied. To transfer the reel 10 onto the working journal 16, the holding members or clamping jaws 41 are disengaged, i.e. retracted in the radial direction.

Figure 4:
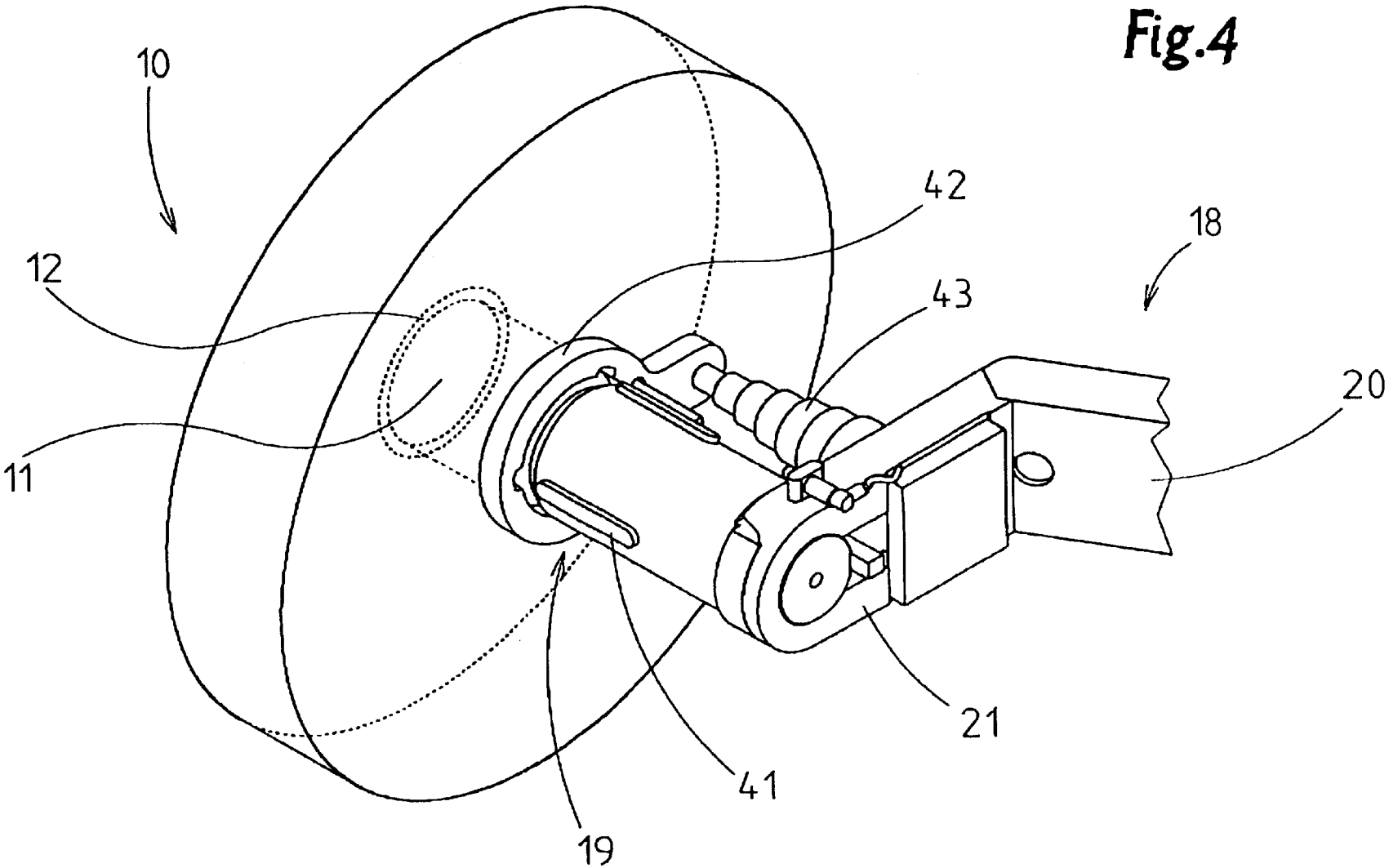
FIG. 4 shows an enlarged perspective view of part of a lifting head with reel.

A further special feature is the transfer of the reel 10 from the conveyor journal 19 onto the working journal 16. When the working journal 16 and conveyor journal 19 are aligned coaxially, the reel is transferred onto the working journal 16 by a slide 42. The slide 42 is designed as a ring which surrounds the conveyor journal 19. In the retracted starting position, the slide 42 lies next to the bearing limb 21 of the lifting head 18 or on this limb. In order to transfer the reel 10 onto the working journal 16, the slide 42 is moved in the axial direction until it reaches the free end of the conveyor journal 19 (FIG. 4).

Figure 3:
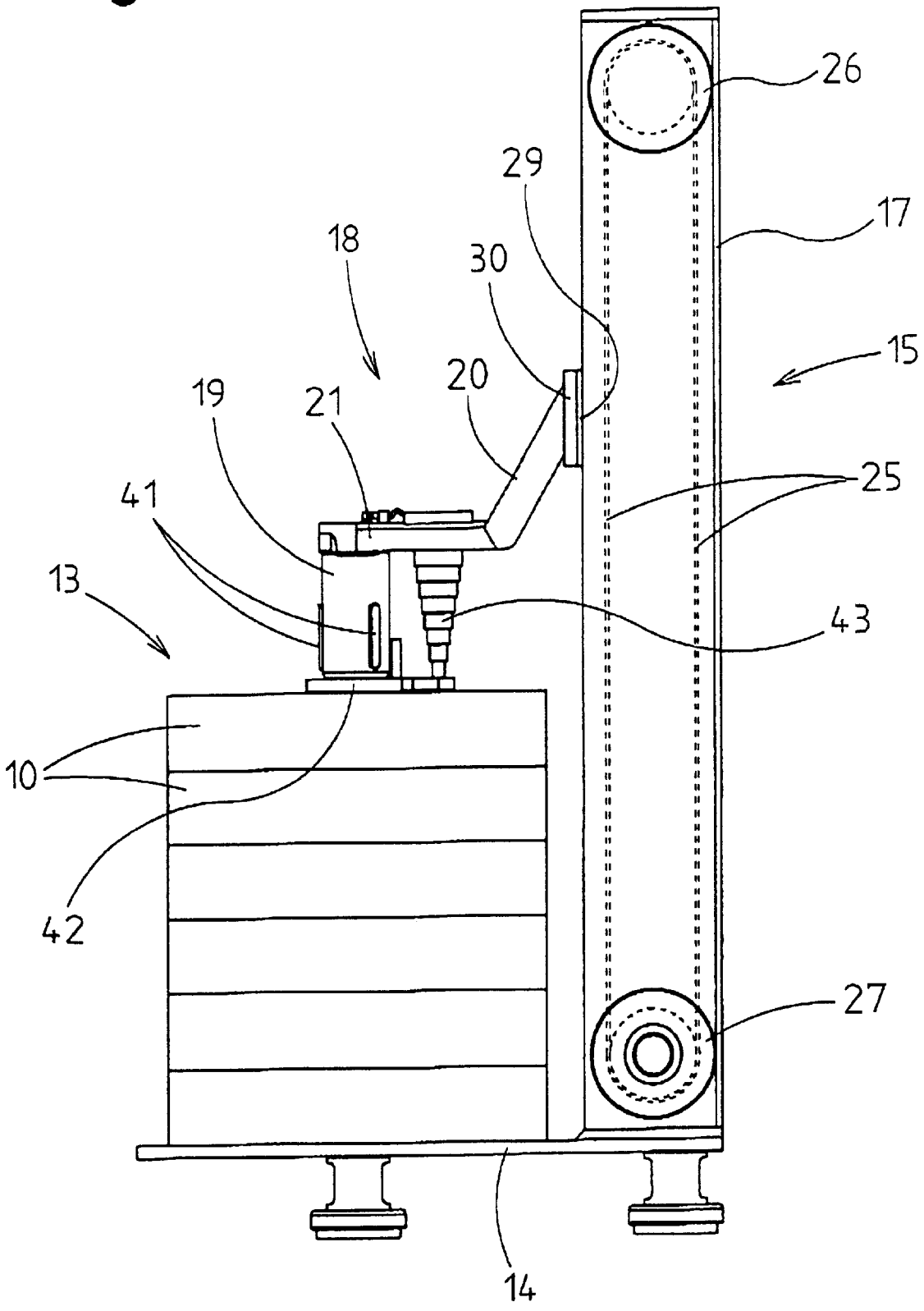
FIG. 3 shows a side view of the reel conveyor in the position in accordance with FIG. 1.

When a reel 10 is being removed from the stock of reels 13, the movement of the lifting head 18 causes the conveyor journal 19 to move into a position precisely above the centre opening 11 in the top reel 10. The slide 42 is in this case expediently in the push-off position and bears in a centring manner against the top side of the reel or against the reel core 12 (FIG. 3). As the lifting head 18 moves further downwards, the conveyor journal 19 moves into the centre opening 11 and, in the process, is moved through the annular slide 42.

An actuating member, namely a (telescopic) cylinder 43, is arranged on the lifting head 18 for the purpose of actuating the slide 42. This cylinder is arranged on the bearing limb 21, parallel to the conveyor journal 19, and is laterally connected to the slide 42. The cylinder 43 comprises a multiplicity of telescopic parts which ensure a precise extension and retraction movement for the slide 42 to be actuated appropriately.

A movable energy chain 44 in which power-supply lines are arranged is arranged in the bearing column 17 in order to supply power to the components arranged on the lifting head 18, namely the clamping jaws 41 of the conveyor journal 19 and the cylinder 43. These power-supply lines are guided to the conveyor journal 19 or to the cylinder 43 via the lifting head 18.

A special feature of the apparatus is the controlled nature of movement. When the reels 10 are transferred to the working journal 16, the sequence of movements of the lifting head 18 in the top limit position reliably ensures that the transfer position is reached. For a reel 10 to be picked up from the stock of reels 13, the conveyor journal 19 is introduced into the centre opening 11 by the downwards movement of the lifting head 18. The movement sequencers are initiated or terminated by means of stops and/or sensors. The same also applies to the actuation of the clamping jaws 41 and of the slide 42.

What is claimed is:

1. Apparatus for handling reels (10), comprising wound material webs of packaging material selected from the group consisting of paper, cardboard, tin foil or film, comprising a reel conveyor (15) for picking-up the reels (10) individually from a stock of reels and feeding the reels to a working journal (16) and which moves into a center opening (11) formed by each reel (10), in conjunction with a packaging machine, including the following features:

a) the reels (10) are positioned above one another in the region of the stock of reels (13), with their center openings (11) extending vertically;

b) the reel conveyor (15) has a lifting head (18) structured to be moved up and down in order to take hold, in each instance, of one reel (10);

c) a reel bearing member for taking hold of a reel (10) in a positively-locking and/or non-positively-locking manner arranged on the lifting head (18);

d) after it has picked up a reel (10) from the stock of reels (13), the lifting head (18) or the reel bearing member are structured to be rotated whereby the reel (10) can be fed to the working journal (16) in the vertical position with the center opening (11) oriented horizontally;

e) after the rotational movement of the lifting head (18), the lifting head (18) is located in an upper end position and positioned directly adjacent to the working journal (16), the reel (10) adapted to being transferred by means of axial movement from the lifting head (18) to the working journal (16);

f) the lifting head being structured to be moved up and down by means of a single vertical drive and adapted to being rotated in the upper end position by a vertical movement; and g) during upward movement of the lifting head, in the region of an upper end position, the lifting head (18) runs against a stop (39) whereby rotational movement is accomplished by virtue of the continued upward movement of the lifting head (18) after reaching the stop (39).

2. Apparatus according to claim 1, wherein a pivot pin (31) with a transverse actuating lever (34) is arranged on the lifting head and is adapted to be conveyed in order to accomplish the rotation of the lifting head (18) as a result of the upward movement against the stop (39).

3. Apparatus according to claim 2, wherein the actuating lever (34), along with a contact roller (38) attached to an end of the actuating lever, runs in a guide groove (37) which forms at the upper end of the stop (39) against which the actuating lever strikes.

* * * * *